US010794242B2

(12) United States Patent
Persson

(10) Patent No.: US 10,794,242 B2
(45) Date of Patent: Oct. 6, 2020

(54) DEVICE FOR CONTROLLING AT LEAST ONE VALVE IN AN INTERNAL COMBUSTION ENGINE

(71) Applicant: VOLVO TRUCK CORPORATION, Gothenburg (SE)

(72) Inventor: Per Persson, Partille (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/078,723

(22) PCT Filed: Mar. 14, 2016

(86) PCT No.: PCT/EP2016/055425

§ 371 (c)(1),
(2) Date: Aug. 22, 2018

(87) PCT Pub. No.: WO2017/157413

PCT Pub. Date: Sep. 21, 2017

(65) Prior Publication Data

US 2019/0055861 A1 Feb. 21, 2019

(51) Int. Cl.
*F01L 13/00* (2006.01)
*F01L 1/18* (2006.01)
(Continued)

(52) U.S. Cl.
CPC ..... *F01L 13/0005* (2013.01); *F01L 1/08* (2013.01); *F01L 1/146* (2013.01); *F01L 1/181* (2013.01);
(Continued)

(58) Field of Classification Search
CPC . F01L 1/26; F01L 1/181; F01L 1/2411; F01L 2001/186; F01L 1/2416;
(Continued)

(56) References Cited

U.S. PATENT DOCUMENTS 4,892,067 A 1/1990 Paul et al.
6,253,730 B1 7/2001 Gustafson
(Continued)

FOREIGN PATENT DOCUMENTS

CN 1969110 A 5/2007
CN 202090975 U 12/2011
(Continued)

OTHER PUBLICATIONS

International Search Report (dated Dec. 21, 2016) for corresponding International App. PCT/EP2016/055425.
China Office Action dated Jun. 9, 2020 in corresponding Chinese Application No. 201680083503.7, 8 pages.

*Primary Examiner* — Jorge L Leon, Jr.
(74) *Attorney, Agent, or Firm* — Venable LLP; Jeffri A. Kaminski

(57) ABSTRACT

A gas valve actuation device for an internal combustion engine includes a first arrangement for actuating two gas valves in a first lift event, a second arrangement for selectively actuating a first one of the two gas valves in a second lift event, a fluid circuit for controlling actuation of the first gas valve in the second lift event, wherein the fluid circuit includes a first fluid circuit valve which is arranged to be controlled by the first actuation arrangement.

24 Claims, 9 Drawing Sheets

A-A

(51) Int. Cl.

| | |
|---|---|
| ***F01L 1/26*** | (2006.01) |
| ***F01L 13/06*** | (2006.01) |
| ***F01L 1/24*** | (2006.01) |
| ***F01L 1/08*** | (2006.01) |
| ***F01L 1/14*** | (2006.01) |
| *F01L 1/46* | (2006.01) |
| *F01L 1/20* | (2006.01) |

(52) U.S. Cl.

CPC ..... *F01L 1/2411* (2013.01); *F01L 1/26* (2013.01); *F01L 13/065* (2013.01); *F01L 1/20* (2013.01); *F01L 2001/467* (2013.01); *F01L 2305/00* (2020.05)

(58) Field of Classification Search

CPC ..... F01L 2001/2438; F01L 1/267; F01L 1/46; F01L 13/0036; F01L 13/06; F01L 13/08

USPC ..... 123/90.12, 90.13, 90.16, 90.39, 90.44, 123/90.36, 90.4, 90.46

See application file for complete search history.

(56) References Cited

U.S. PATENT DOCUMENTS

| | | | | |
|---|---|---|---|---|
| 8,225,769 | B2 * | 7/2012 | Dilly | F01L 13/06 123/321 |
| 8,627,791 | B2 | 1/2014 | Janak et al. | |
| 8,714,125 | B2 * | 5/2014 | Kamichika | F01L 1/047 123/90.16 |
| 2012/0048232 | A1 * | 3/2012 | Meistrick | F01L 1/18 123/321 |
| 2014/0020644 | A1 | 1/2014 | Roberts et al. | |

FOREIGN PATENT DOCUMENTS

| | | | |
|---|---|---|---|
| CN | 102414424 | A | 4/2012 |
| CN | 104500164 | A | 4/2015 |
| EP | 0974740 | A2 | 1/2000 |
| EP | 2677127 | A1 | 12/2013 |
| WO | 2010126479 | A1 | 11/2010 |
| WO | 2012015970 | A1 | 2/2012 |
| WO | 2015177127 | A1 | 11/2015 |

* cited by examiner

DEVICE FOR CONTROLLING AT LEAST ONE VALVE IN AN INTERNAL COMBUSTION ENGINE

BACKGROUND AND SUMMARY

The invention relates to an engine valve actuation device, especially for actuating poppet valves. The engine valve actuation device may be arranged to evacuate exhaust gases from a combustion cylinder or supply intake gas (air plus maybe EGR) to the combustion cylinder.

The invention can be applied in heavy-duty vehicles, such as trucks, buses and construction equipment. Although the invention will be described with respect to a truck, the invention is not restricted to this particular vehicle, but may also be used in other vehicles such as passenger cars, buses and construction equipment. Further, the invention will be described with examples to evacuate exhaust gases from a combustion cylinder, but may alternatively be used to supply intake gas (air plus maybe EGR).

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft. As a complementary device, a cam phaser might be used for changing phase angle between engine crankshaft and engine camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main exhaust valve event is required for positive power operation of an internal combustion engine. Additional auxiliary valve events. While not required, may be desirable. For example, it may be desirable to actuate the exhaust valves for compression-release engine braking, bleeder engine braking, exhaust gas recirculation (EGR), brake gas recirculation (BGR), or other auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

According to a known technology, the valve train mechanism provides for opening of two exhaust valves during a main valve lift event and opening of only one of said exhaust valves during a secondary lift event such as for engine braking. During decompression, there may be large forces in the valve train and by opening only one of the exhaust valves the threes may be reduced to half. A first rocker arm may be arranged for the main lift event used both during positive and negative power and a second rocker arm may be arranged for the secondary lift event. The first rocker arm may be arranged to actuate both exhaust valves simultaneously via a valve bridge. The second rocker arm may be arranged to actuate a single one of said exhaust valves via a sliding pin arranged in a bore in the valve bridge.

WO2010/126479 discloses system for actuating an engine valve. The system includes a rocker arm shaft having a control fluid supply passage and an exhaust rocker arm pivotally mounted on the rocker arm shaft. A cam for imparting main exhaust valve actuation to the exhaust rocker arm contacts a cam roller associated with the exhaust rocker arm. A valve bridge is disposed between the exhaust rocker arm and first and second engine valves. A sliding pin is provided in the valve bridge, said sliding pin contacting the first engine valve. An engine braking rocker arm is pivotally mounted on the rocker arm shaft adjacent to the exhaust rocker arm. The engine braking rocker arm has a central opening, a hydraulic passage connecting the central opening with a control valve, and a fluid passage connecting the control valve with an actuator piston assembly. The actuator piston assembly includes an actuator piston adapted to contact the sliding pin during engine braking operation. A cam is provided for imparting engine braking actuation to the engine braking rocker arm. A plate is fastened to a back end of the engine braking rocker arm, and a spring biases the plate and the engine braking rocker arm into contact with the cam.

One problem with WO2010/126479 is that the engine braking operation is dependent on conditions like thermal elongation (dependent on an engine operational state or temperature), tolerances during manual lash setting or wear in valve train. More specifically, the valve lash adjustment is controlled by a piston in the actuator piston assembly, which piston has a set stroke, wherein the piston may thereby reduce a lash space to different extents dependent on the above conditions. This in turn has an impact on the degree of activation of the cam lobe for the engine braking operation.

Both EP 2 677 127 A1 and U.S. Pat. No. 6,253,730 B1 disclose rocker arms with control valves, which control valves are reset valves for allowing flow forward or emptying a hydraulic chamber behind a slave piston. EP 0 974 740 A2 discloses a fluid circuit valve which moves with the piston movement and indirectly with the rocker arm. There is however no indication of die nature of these movements.

It is desirable to provide an engine valve actuation device, which creates conditions for achieving engine braking in a robust way.

According to an aspect of the invention, a gas valve actuation device for an internal combustion engine comprises a first means for actuating two gas valves in a first lift event, a second means for selectively actuating a first one of said two gas valves in a second lift event, a fluid circuit for controlling actuation of said first gas valve in the second lift event, characterized in that the fluid circuit comprises a first fluid circuit valve, which is arranged to be controlled by the first actuation means.

This creates conditions for opening and closing the first fluid circuit valve depending on the state or position of the first actuation means. This, in turn creates conditions for achieving an exact positioning of the second actuation means in an engaged state regardless of conditions like the elongation (dependent on an engine operational state or temperature) tolerances during manual lash setting or wear in valve train. This in turn creates conditions for a uniform engine braking operation regardless of the conditions. In other words, it creates conditions for adjusting the lash to zero in between main lift event and decompression bump event. More specifically, the first fluid circuit valve in the fluid circuit may be arranged between a fluid supply port and an actuator piston for actuating the first one of said two gas valves and in such a way that the first fluid circuit valve is adapted to block a communication between the fluid supply port and the actuator piston when the first fluid circuit valve is actuated by the first actuation means. In other words, by arranging the first fluid circuit valve in such a way that it is controlled with regard to opening and closing the fluid circuit by the first actuation means, a robust way of controlling the second lift event is achieved. According to one example, the first fluid circuit valve is directly controlled by the first actuation means.

According to one example, the fluid circuit is formed by a hydraulic circuit, comprising a hydraulic fluid, such as oil.

According to a further example, the first actuation means is adapted for actuating the two gas valves simultaneously in the first lift event. According to a further example, the second actuation means is adapted for actuating only the first one of said two gas valves in the second lift event.

According to a further example, each one of the first actuation means and the second actuation means comprises a mechanism or linkage for actuating the two gas valves in the first lift event and the second lift event, respectively.

According to one embodiment, the first fluid circuit valve is arranged to be open when the two gas valves are not actuated for the first lift event and closed when the two gas valves are actuated for the first lift event. This, in turn creates conditions for achieving an exact positioning of the second actuation means in an engaged state regardless of the conditions mentioned above. This in turn creates conditions for a uniform engine braking operation irrespective of the conditions.

According to one example, the first fluid circuit valve is arranged to be open only when the two gas valves are not actuated for the first lift event.

According to a further embodiment, the second actuation means comprises the fluid circuit. In other words, at least a part of the fluid circuit is incorporated in the second actuation means. According to one example, the second actuation means is formed by at least one body and fluid lines of the fluid circuit are arranged inside of the body.

According to a further embodiment, the first actuation means comprises a first rocker arm for actuating the two gas valves in the first lift event, and the second means comprises a second rocker arm for actuating the first one of said two gas valves in the second lift event.

According to one example, the second rocker arm is arranged adjacent the first rocker arm. Further, each one of the first rocker arm and the second rocker arm are arranged to pivot around a pivot axis. According to a further example, each one of the first rocker arm and the second rocker arm comprises a through hole for receiving a rocker arm shaft, around which the rocker arms are pivotally arranged.

According to a further embodiment, the first fluid circuit valve comprises a moveably arranged control member, which is arranged in such a way in relation to the first rocker arm that it may be moved by a movement of the first rocker arm for opening and closing the valve. The arrangement of the control member relative to the first rocker arm creates further conditions for securing a robust control of the gas valve actuation.

According to one example, the control member is moveable between different positions effecting a fluid flow in the hydraulic circuit to different extents.

According to a further embodiment, the control member is adapted to engage with the first rocker arm.

According to a further embodiment, the control member is moveably arranged in the second rocker arm. This is a space efficient way of securing a robust control of the gas valve actuation.

According to a further embodiment, the control member is moveably arranged in a direction substantially in parallel with a movement direction of the first rocker arm during the first lift event.

According to one example, the first rocker arm is adapted to pivot around a pivot axis defined by a centre axis of a rocker arm shaft. According to a further example, the control member is adapted to perform a linear movement back and forth. Depending on the arrangement of the control member, there may be a relative movement between the contact points of the rocker arm shaft and the control member. The device may be adapted to reduce any negative effects of this relative movement, such as designing the first rocker arm and/or the control member for allowing the relative movement and/or arranging the control member in a part that is adapted for performing a pivoting movement similar to the first rocker arm. This pivot part may be constituted by the second rocker arm.

According to a further embodiment, the control member comprises a first contact surface at a first end and wherein the first contact surface is adapted to engage with a corresponding contact surface of the first rocker arm. According to one example, the control member and the first rocker arm are adapted for a direct engagement with each other via the contact surfaces. This creates conditions for securing a robust control of the gas valve actuation.

According to a further embodiment, the control member is slidably arranged in a bore. Preferably, the control member is formed by a cylindrical body having an axis defining the sliding direction. According to one example, the control member is adapted for a linear movement back and forth in said bore.

According to a further embodiment, the valve comprises a spring-biased part adapted to control fluid flow in the fluid circuit, and wherein the control member is arranged to actuate the spring-biased part.

According to one example, the spring-biased part is formed by a ball, which is adapted to be arranged in a sear being provided with a port for a fluid communication line of the fluid circuit, wherein the spring is adapted to urge the part to a closed position, wherein the ball is seated in the seat covering the port. Further, the control member is arranged to move the spring-biased part away from the seat and thereby allowing fluid communication via the port.

According to a further embodiment, the control member comprises a second contact surface at a second end opposite the first end and wherein the second contact surface is arranged to engage with the spring-biased part.

According to a further embodiment, the fluid circuit comprises a piston for controlling said single one of said two gas valves in the second lift event. According to one example, the piston is spring-biased, wherein the spring is adapted to urge the piston to a retracted position. According to one example, the first fluid circuit valve is arranged to control fluid supply to the piston. According to one example, the piston is arranged on the second rocker arm.

According to a further embodiment, the device comprises a rocker arm shaft and wherein the second rocker arm is pivotally arranged on said shaft. According to one example, the first rocker arm is pivotally arranged on the same rocker arm shaft as the second rocker arm.

According to a further development of the last mentioned embodiment, the rocker arm shaft comprises a fluid supply passage adapted to provide fluid to the fluid circuit.

According to a further embodiment, the fluid circuit comprises a check valve for preventing a reverse fluid flow in the hydraulic circuit and wherein the check valve is arranged in series with the first fluid circuit valve.

According to a further embodiment, the device comprises a camshaft arrangement provided with a first cam adapted for actuating the first rocker arm for the first lift event and second cam adapted for actuating the second rocker arm for the second lift event.

The cam has an external profile, designed for its associated lift event. More specifically, the cam profile has a non-circular shape. According to one example, each cam comprises a first circumferential portion having a circular shape (a base circle) and a second circumferential portion with a larger radial extension than the first circumferential portion. The second circumferential portion may be formed by at least one projection, such as a bump or lobe. According to a further embodiment, the first fluid circuit valve is arranged to be open when the first rocker arm is following a base circle of the cam and closed when the first rocker arm is following the lobe of the first cam.

According to a further embodiment, the first rocker arm comprises a contact portion adapted to engage the control member.

According to a further development of the last mentioned embodiment, the first rocker arm has a main extension direction in a transverse direction in relation to a rotational axis of the camshaft arrangement, wherein the first rocker arm comprises a boss projecting in a transverse direction in relation to the main extension direction and wherein the boss comprises the contact portion.

According to a further embodiment, the two gas valves are exhaust valves.

According to a further embodiment, the device comprises a valve bridge extending between the two gas valves for actuating both gas valves in the first lift event and wherein the first rocker arm is adapted for actuating the two gas valves via the valve bridge.

According to a further development of the last mentioned embodiment, the valve bridge comprises an opening in register with the first one of said two gas valves, wherein the device comprises a pin slidably arranged in said opening and wherein the second rocker arm is adapted for selectively actuating the first one of the two gas valves via the sliding pin.

The invention is further related to an internal combustion engine comprising a cylinder provided with two intake valves and two exhaust valves and an engine valve actuation device according to any preceding embodiment for actuating either to two intake valves or the two exhaust valves.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
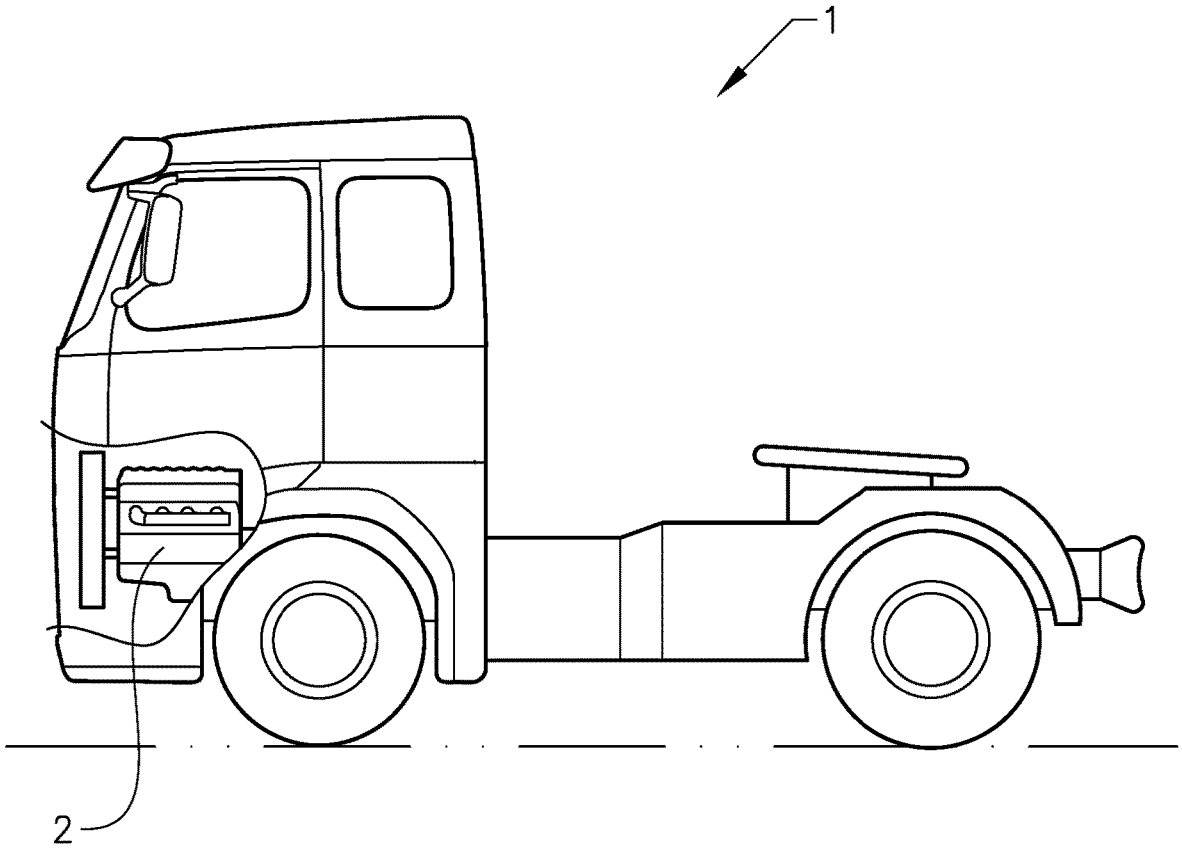
FIG. 1 shows a vehicle in the form of a truck in a partly cut side view.

FIG. 1 shows a vehicle in the form of a truck 1 in a partly cut side view. The truck 1 comprises an internal combustion engine 2 in the form of a diesel engine.

Figure 2:
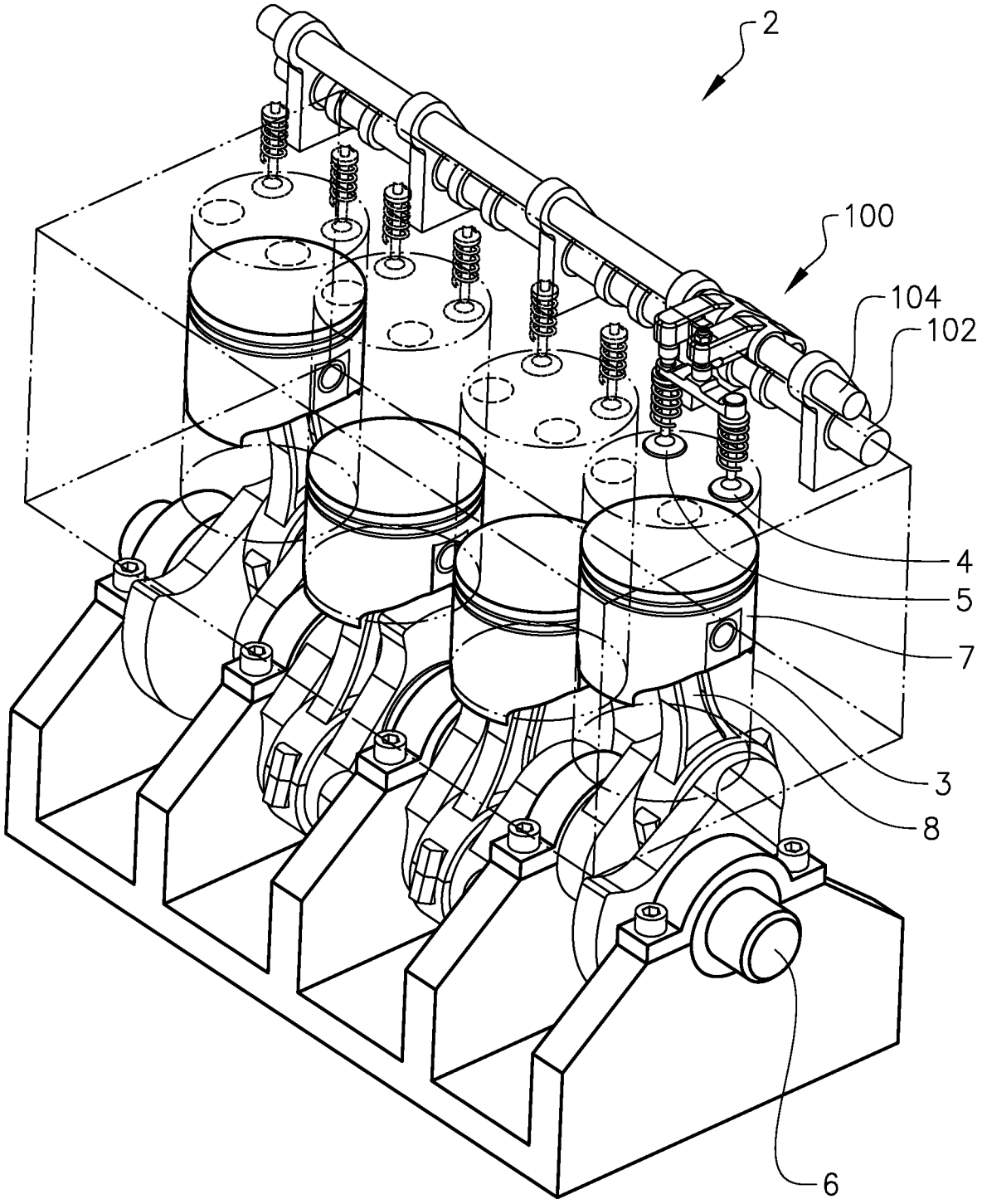
FIG. 2 is a schematic perspective view of a first embodiment of an engine for the truck in FIG. 1, FIG. 3 discloses a schematic perspective view of a gas valve actuation device from a camshaft side in the first embodiment of an engine according to FIG. 2, FIG. 4 discloses a view from above of the gas valve actuation device according to FIG. 3, FIG. 5 discloses a cut view of the gas valve actuation device according to FIG. 3 along the line A-A indicated in FIG. 4, FIG. 6 discloses a cut view of the gas valve actuation device according to FIG. 3 along the line B-B indicated in FIG. 4, FIG. 7 discloses a schematic perspective view of the gas valve actuation device according to FIG. 3 from a gas valve side, FIG. 8 discloses a side view of the gas valve actuation device according to FIG. 7, and FIG. 9 discloses a valve lift diagram for the gas valve actuation device according to FIG. 3.

FIG. 2 is a schematic perspective view of a first embodiment of the engine 2. The engine 2 comprises at least one cylinder 3 and in the shown example a plurality of cylinders. More specifically, the engine 2 comprises four cylinders in the shown example. However, the engine may be provided with any number of cylinders, such as six cylinders. The engine 2 comprises a cylinder 3 provided with at least one intake valve and at least one exhaust valve 4, 5. More specifically, the cylinder 3 is provided with two intake valves and two exhaust valves 4,5. Further, the engine 2 comprises a crankshaft 6. The crankshaft 6 is connected to a piston 7 in the cylinder 3 via a connecting rod 8 for transmitting a downward motion of the piston to a rotating motion of the crankshaft. Further, the engine 2 comprises a valve actuation device 100. The engine gas valves referenced constitute poppet-type valves that are used to control communication between the combustion chambers (e.g., cylinders) the engine and aspirating (e.g., intake and exhaust) manifolds. While the valve actuation device 100 may be used potentially for intake valve actuation, the remainder of this description describes use of the device for exhaust valve actuation.

The valve actuation device 100 comprises a camshaft 102. The camshaft 102 is driven by the crankshaft rotation via a transmission (not shown). The valve actuation device 100 further comprises a rocker arm shaft 104 in parallel with the camshaft 102. The rocker arm shaft 104 is stationary (non-rotating).

Figure 3:
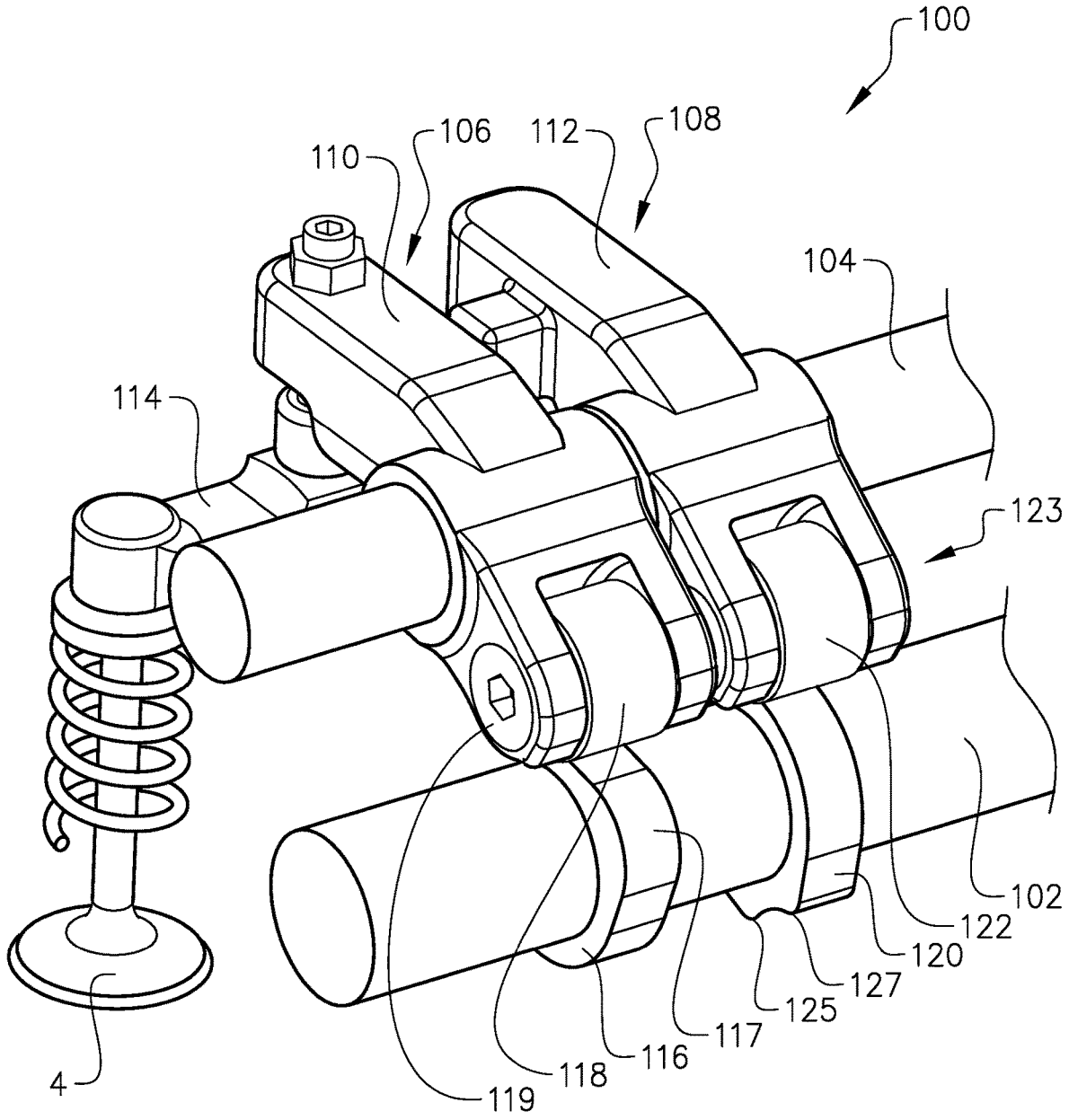
Figure 4:
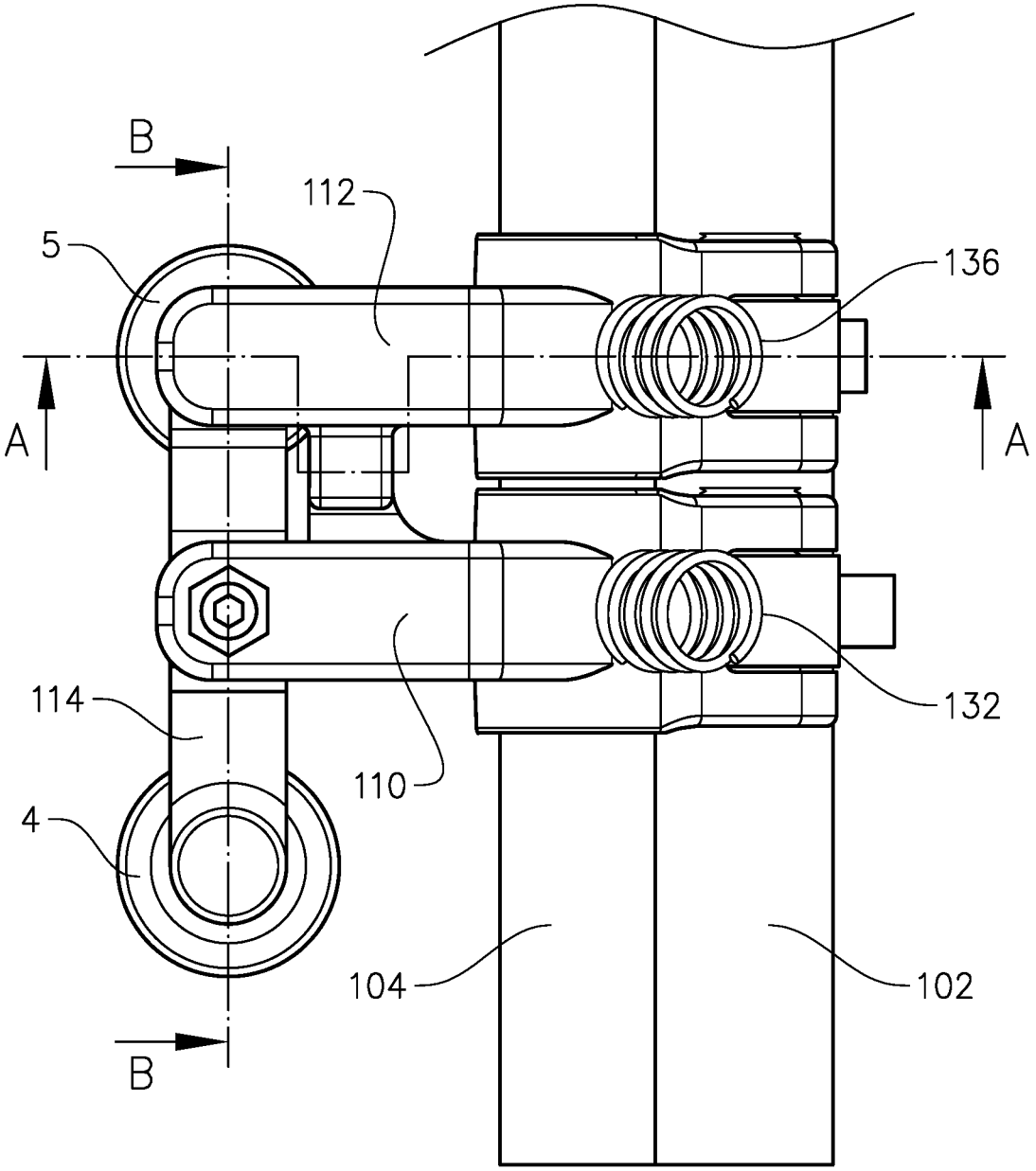

Turning now to FIG. 3, The valve actuation device 100 comprises a first means 106 for actuating the two gas valves 4,5 in a first lift event and a second means 108 for selectively actuating a first one 5 of said two gas valves in a second lift event. The first means 106 is adapted for actuating the two gas valves 4,5 simultaneously in the first lift event. The first means 106 comprises a first rocker arm 110 for actuating the two gas valves 4,5 in the first lift event and the second means 108 comprises a second rocker arm 112 for selectively actuating the first one 5 of said two gas valves in the second lift event. The two rocker arms 110,112 are adjacent each other and pivotally disposed on said rocker arm shaft 104.

The first rocker arm 110 forms an exhaust rocker arm and the second rocker arm 112 forms an engine braking rocker arm. The rocker arms 110,112 may be pivoted about the rocker arm shaft 104 as a result of motion imparted to them by the camshaft 102 or some other motion imparting device, such as a push tube.

Figure 7:
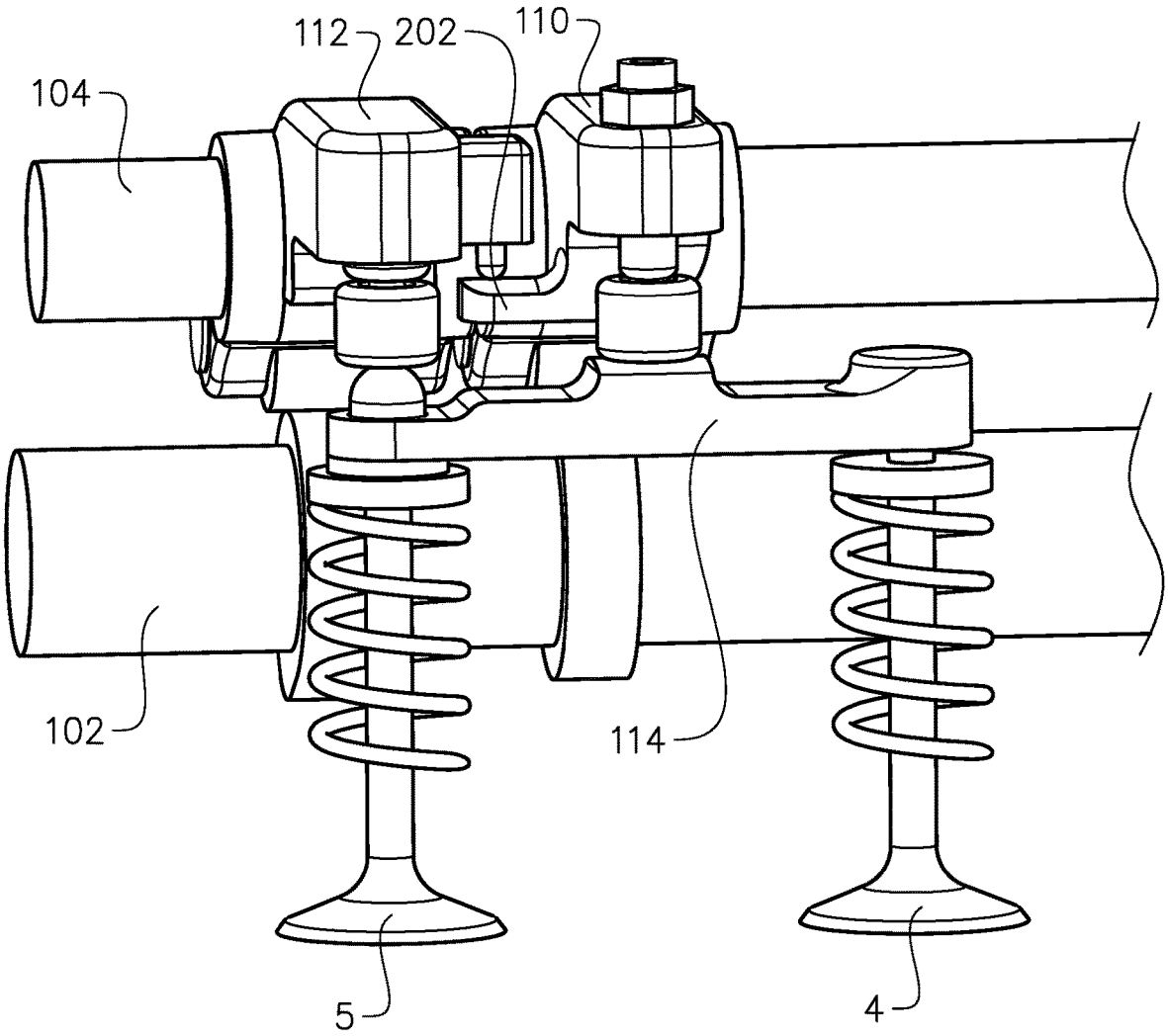
Figure 8:
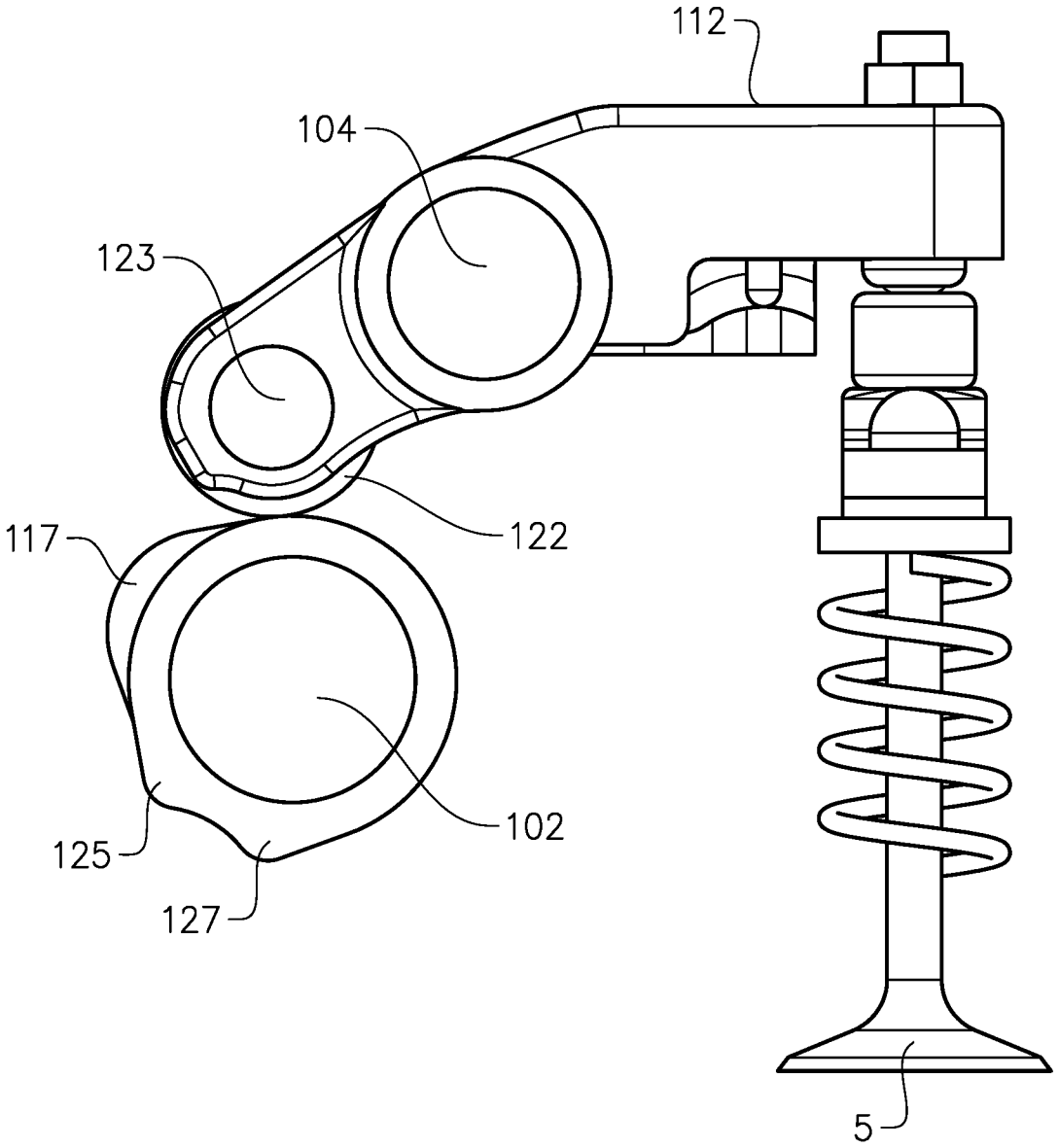

Turning now also to FIG. 7, the exhaust rocker arm 110 is adapted to actuate the exhaust valves 4,5, by contacting them through a valve bridge 114. The exhaust rocker arm 110 may be pivoted by rotation of a cam 116 rigidly attached to or formed in one-piece with the cam shaft 102. The cam 116 having a bump or lobe 117 on it which contacts a earn roller 118 provided mounted on a shaft 119 provided at one end of the exhaust rocker arm 110.

The engine braking rocker arm 112 may be pivoted by rotation of a cam 120 rigidly attached to or formed in one-piece with the cam shaft 102. The cam 120 has at least one engine braking bump or lobe 125, 127 on it. More specifically, the cam 120 having two bumps or lobes 125, 127 (see FIG. 3) distributed in the circumferential direction of the cam 120. More specifically, the cam 120 has a base circle region, wherein the lobes 125,127 projects radially from the base circle region and thereby have a greater diametrical distance from the center of the cam as compared with base circle region of the cam 120. The cam 120 may contact a cam roller 122 mounted on a shall 123 provided at one end of the engine braking rocker arm 112.

Figure 5:
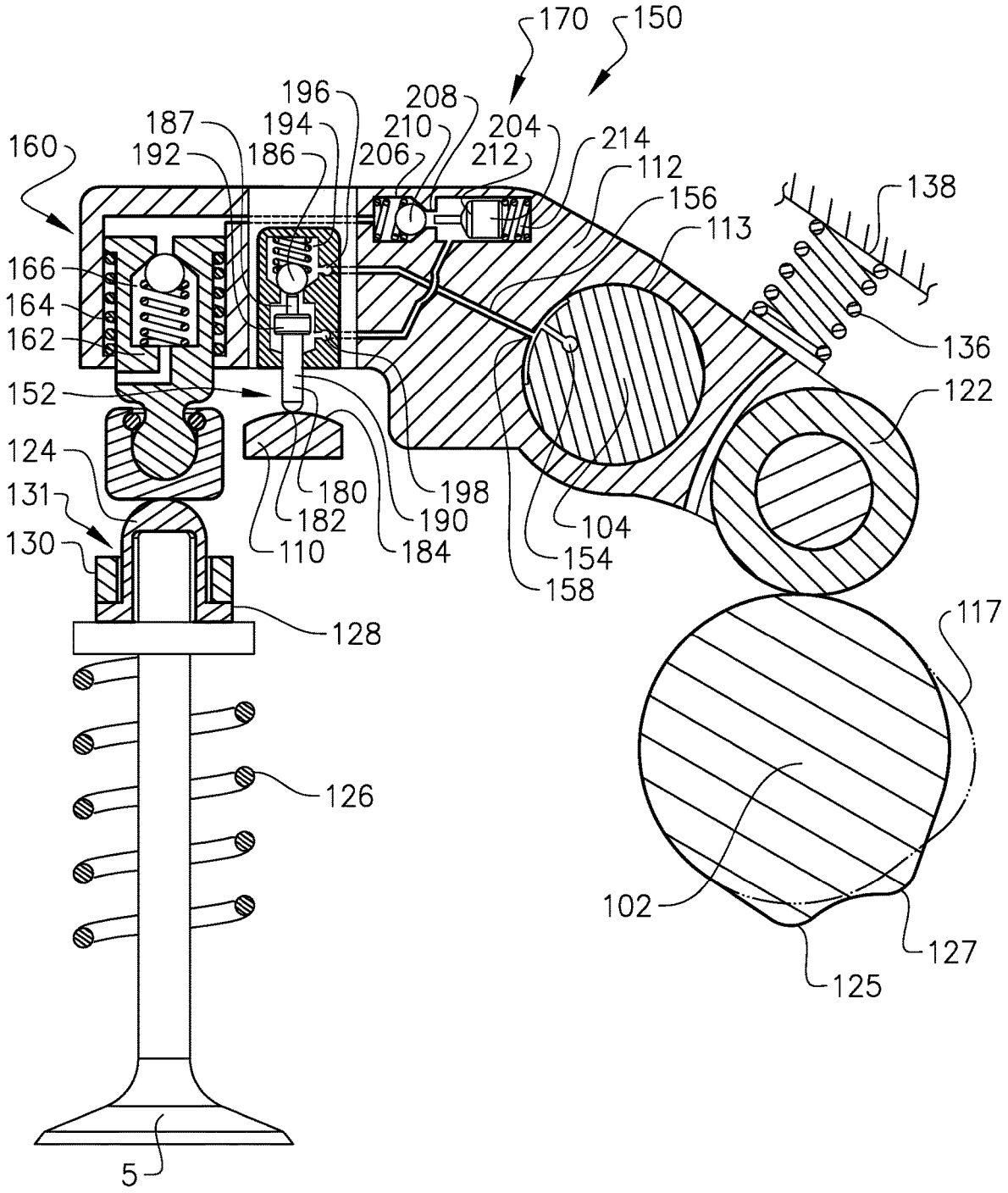

The engine braking rocker arm 112 is adapted to selectively actuate one exhaust valve 5 by contacting a sliding pin 124 provided in the valve bridge 114, which in turn contacts the exhaust valve 5. Turning now also to FIG. 5, the sliding pin 124 is linearly moveably arranged in a bore 131 extending through the valve bridge 114. The exhaust valve 5 may be biased upward, into a closed position, towards the sliding pin 124 by a valve spring 126. The sliding pin 124 comprises a shoulder 128 adapted to mate with a corresponding shoulder 130 in the valve bridge 114. The bias of the valve spring 126 may cause the shoulder 128 on the sliding pin 124 to engage the mating shoulder 130 within the valve bridge 114.

The second rocker arm 112 includes a rocker shaft bore 113 extending laterally through a central portion of it for receiving the rocker arm shaft 104.

Figure 6:
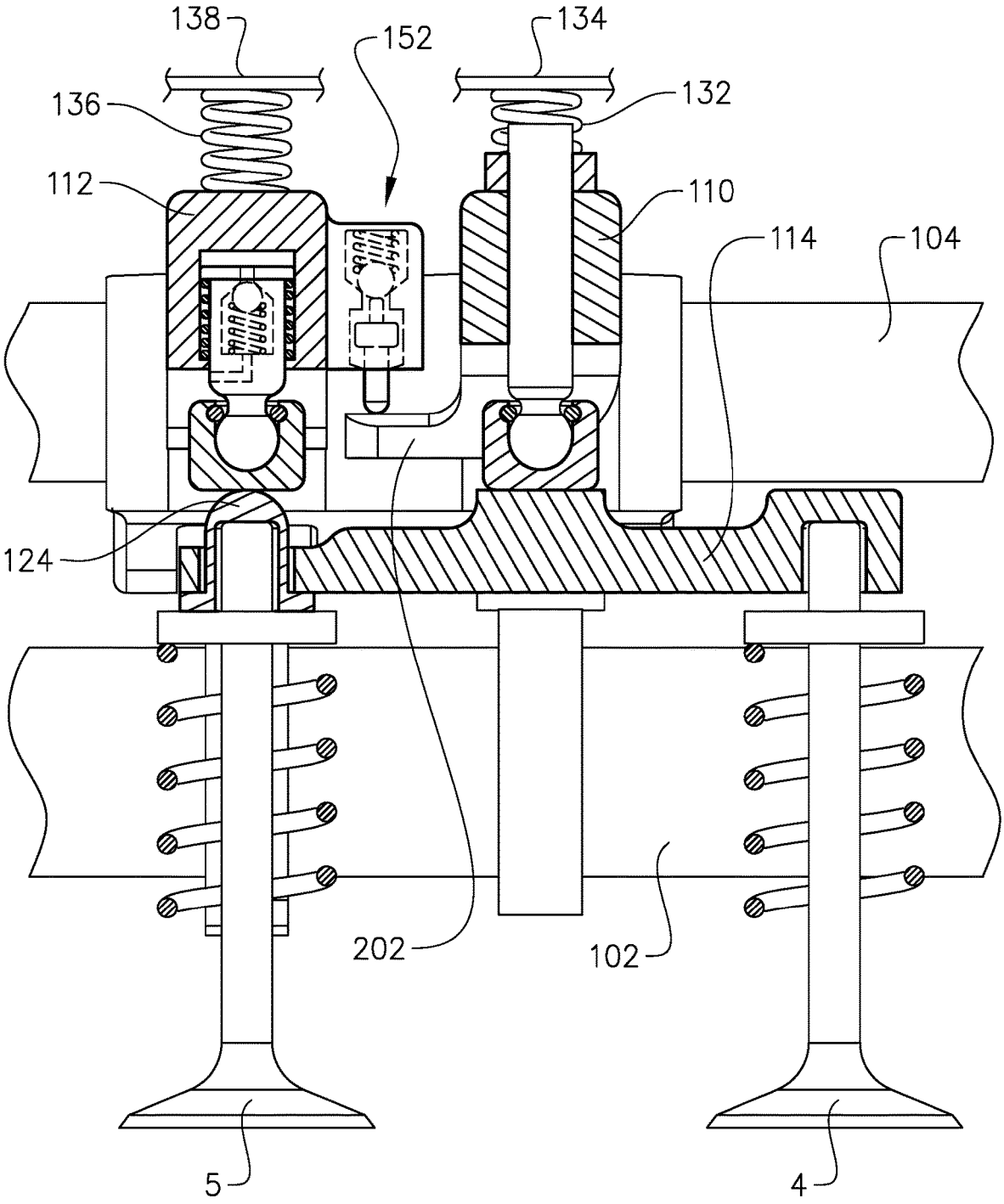

Turning now also to FIG. 6, a first coil spring 132 is adapted to engage the first rocker arm 110 to bias the first rocker arm 110 towards the cam 116. The spring 132 may push against a bracket 134 or other fixed element. The spring 132 may have sufficient force to maintain the first rocker arm 110 in contact with the cam 116 throughout the rotation of the cam shaft. For ease of presentation, the spring 132 is not disclosed in all figures disclosing the first embodiment.

A second coil spring 136 is adapted to engage the second rocker arm 112 to bias the second rocker arm 112 towards the cam 120. The spring 136 may push against a bracket 138 or other fixed element. The spring 136 may have sufficient force to maintain the second rocker arm 112 in contact with the cam 120 throughout the rotation of the cam shaft. For ease of presentation, the spring 136 is not disclosed in all figures disclosing the first embodiment.

Turning now again to FIG. 5, the gas valve actuation device 100 comprises a first fluid circuit 150 for controlling actuation of said first gas valve 5 in the second lift event. The fluid circuit 150 comprises a first fluid circuit valve 152, which is arranged to be controlled by a position of the first rocker arm 110. The fluid circuit 150 is funned by a hydraulic circuit, comprising a hydraulic fluid, such as engine oil. The first fluid circuit valve 152 is arranged to be open when the two gas valves 4,5 are not actuated for the first lift event and closed when the two gas valves 4,5 are actuated by the first rocker arm 110 for the first lift event. More specifically, the first fluid circuit valve 152 is arranged to be open only when the two gas valves 4,5 are not actuated for the first lift event.

The first fluid circuit valve 152 comprises a moveably arranged control member 180, which is arranged in such a way in relation to the first rocker arm 110 that it may be moved by a movement of the first rocker arm 110 for opening and closing the valve 152.

The control member 180 is moveable between different positions effecting a fluid flow in the hydraulic circuit to different extents. More specifically, the control member 180 is adapted to engage with the first rocker arms 110. Further, the control member 180 is moveably arranged in the second rocker arm 112. The control member 180 is moveably arranged in a direction substantially in parallel with a movement direction of the tint rocker arm 110 during the first lift event.

The control member 180 comprises a first contact surface 182 at a first end and wherein the first contact surface is adapted to engage with a corresponding contact surface 184 of the first rocker arm 110. More specifically, the control member 180 is slidably arranged in a bore. Further, the control member 180 is formed by a cylindrical body. Further, the control member 180 comprises a first relatively thin elongated portion 190 and an enlarged portion 192 in one piece with the elongated portion 190. The enlarged portion 192 has a larger transverse extension than the elongated portion 190 has. The enlarged portion 192 forms an axial stop and is adapted to form a radial gap in relation to an internal wall of the second rocker arm. Further, the enlarged portion 192 is positioned at a distance from each end of the elongated portion 190.

The first fluid circuit valve 152 comprises a spring-biased part 186 adapted to control fluid flow in the fluid circuit, and wherein the control member 180 is arranged to actuate the spring-biased part 186. The control member 180 comprises a second contact surface 187 at a second end opposite the first end and wherein the second contact surface 187 is arranged to engage with the spring-biased part 186. The spring-biased part 186 is formed by a ball, which is adapted to be engaged by the upper surface 187 of the control member 180.

Further, the second rocker arm 112 comprises the fluid circuit 150. The second rocker arm 112 further comprises a chamber 194 for housing the enlarged portion 192 of the control member 180.

The rocker arm shaft 104 comprises one or more internal passages such as fluid supply passage 154 for the delivery of the hydraulic fluid to the second rocker arm 112 mounted thereon. Specifically, the rocker arm shaft 104 may include a constant fluid supply passage (not shown) and a control fluid supply passage. The constant fluid supply passage may provide lubricating fluid to one or more of the rocker arms during engine operation.

The fluid circuit 150 comprises one or more internal passages, such as hydraulic passage 156 for the delivery of hydraulic fluid through it, which fluid is received from a port 158 to the bore 113 housing the rocker arm shaft 104. The port 158 is in fluid communication with the fluid supply passage 154 in the rocker arm shall 104.

The fluid circuit 150 further comprises an actuator piston assembly 160, which is in communication, with the port 158 for engine braking valve actuation. The second rocker arm 112 includes a valve actuation end having the actuator piston assembly 160. The actuator piston assembly 160 may include a slide-able actuator piston 162 disposed in a bore provided in the engine braking rocker arm. A spring 164 may be provided for biasing the actuator piston 160 upward, away from the sliding pin 124, by acting on the actuator piston. The actuator piston assembly 160 is adapted to engage an upper surface of the sliding pin 124 for controlling the second valve 5. The internal passages 156 in the second rocker arm 112 are adapted to permit hydraulic fluid to be provided to the first fluid circuit control valve 152 and the actuator piston assembly 160.

The actuator piston assembly 160 comprises a safety valve 166. If the fluid pressure in the cavity above piston 162 exceeds a certain pressure p3 (p3>>p2; p3 is much larger than p2), a spring-biased body of the safety valve 166 will, open a passage for the fluid to be evacuated out under a valve cover.

Turning now again to the first fluid circuit valve 152, the chamber 194 comprises a first port 196 on a first, upper side of the section receiving the enlarged portion 192 of the control member 180. The first port 196 is in fluid communication with the port 158 to the bore 113. The chamber 194 comprises a second port 198 on a second, lower side of the section receiving the enlarged portion 192 of the control member 180. The second port 198 is in fluid communication with the actuating actuator piston assembly 160.

The hydraulic fluid may be selectively supplied to the first fluid circuit control valve 152 and the actuator piston assembly 160 under the control of a solenoid valve, or other electrically controlled valve (not shown).

The fluid circuit 150 further comprises a check valve 170 arranged between the first fluid circuit valve 152 and the actuator piston assembly 160 for controlling fluid supply. More specifically, the check valve 170 is adapted for preventing a reverse fluid flow in the hydraulic circuit and wherein the check valve is arranged in series with the first fluid circuit valve 152. The check valve 170 comprises two chambers 204, 206, which are in communication with each other via a passage 208. A port of the first chamber 204 is connected to the fluid supply passage 154 via the fluid circuit line 156. Further, a port of the second chamber 206 is connected to the actuator piston 160. The check valve 170 comprises a spring-biased body 210 provided in the second chamber for blocking fluid flow from the second chamber to the first chamber 204 via the passage 208. In other words, the spring-biased body 210 is adapted for preventing a reverse fluid flow in the hydraulic circuit. The check valve 170 further comprises a control element 212, which is moveably arranged for actuating, the body 210 against the spring force and thereby allowing through flow of fluid from the first chamber 204 to the second chamber 206 via the passage 208. The control element 212 comprises a first portion adapted to slidably engage with a wall of the first chamber 204 and a second portion adapted to actuate the spring-biased body 210 for opening the passage 208 for fluid through-flow. The second portion is, adapted, to be arranged in the passage and has a smaller transverse extension than an inner extension of the passage 208 for allowing a fluid through-flow in the passage 208 when the spring-biased body 210 is moved away from its associated seat. The control element 212 is sensitive to fluid pressure in fluid circuit line 156. When fluid pressure is below pressure p1 a spring 214 to the right of control element 212 overcomes the force from fluid pressure and control element 212 will move the spring-biased body 210 away from the passage 208 and fluid is free to flow without restriction in both directions through passage 208. When fluid pressure is above pressure p2(p2>p1) fluid pressure acting on control element 212 will overcome the spring force from the spring 214 and control element 212 will be biased in a right most position. When the control element 212 is in the right most position the spring-biased body 210 will seal the passage 208 for fluid return (backward) flow but still allow forward flow towards piston assembly 160.

The first fluid circuit valve 152 is arranged to be open when the first rocker arm 110 is following a base circle of the cam and closed when the first rocker arm is following the first cam lobe.

The first rocker arm 110 has a main extension direction in a transverse direction in relation to a rotational axis of the camshaft arrangement, wherein the first rocker arm 110 comprises a projection or boss 202 projecting in a transverse direction in relation to the main extension direction and wherein the boss comprises the contact portion 184. The projection 202 may be formed in one-piece with the first rocker arm 110 or by a separate arm rigidly attached to the first rocker arm 110.

Figure 9:
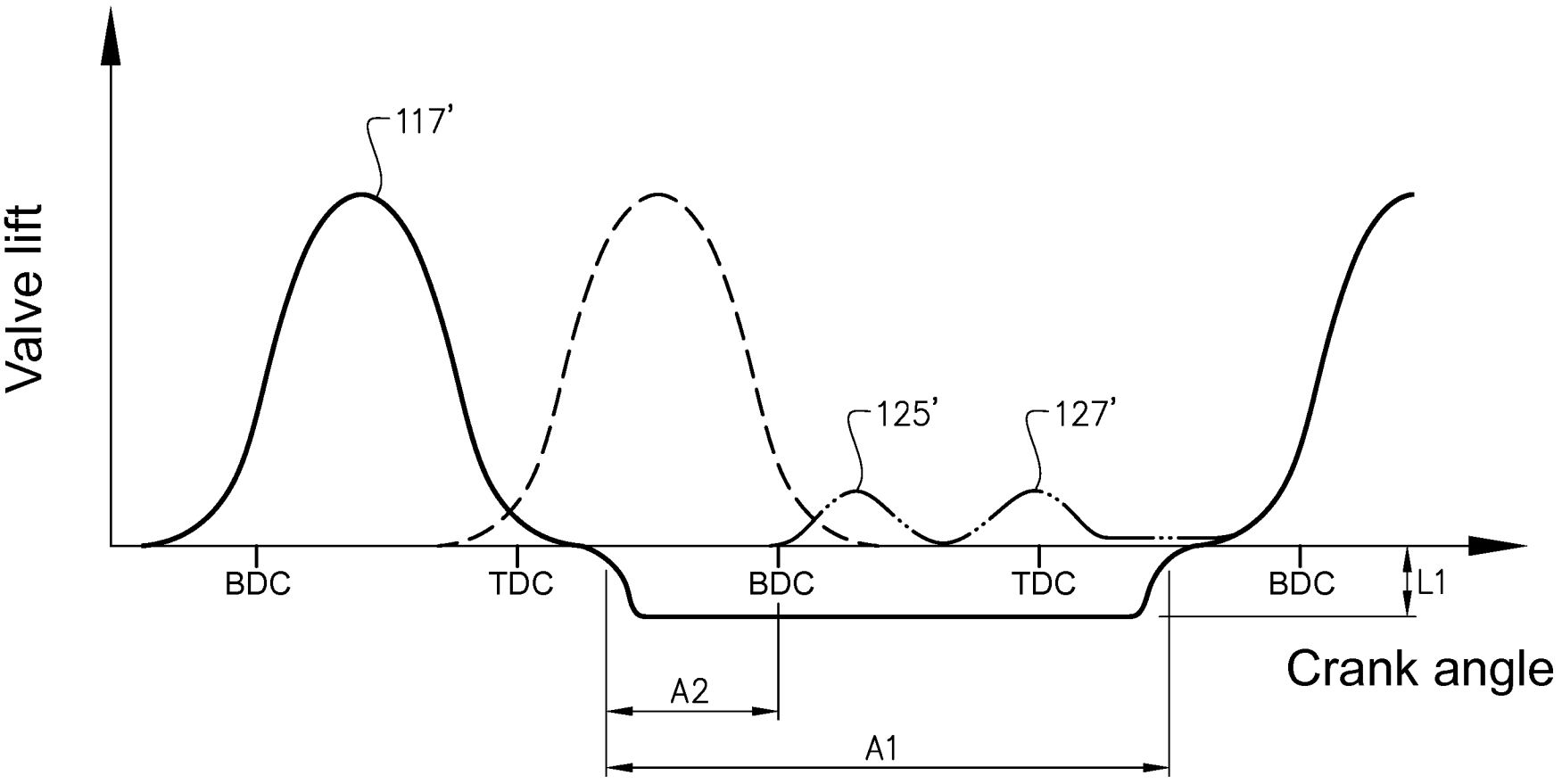

Turning now to FIG. 9, it discloses valve lift as a function of crank angle. The external shape of the first cam 116 for exhaust valve control is defined by a continuous line. More specifically, the lobe 117 is defined by the line portion 117'. Further, a dotted line represents a shape of a cam for air intake valve control. The external shape of the second cam 120 for engine braking is defined by a point-dotted line. More specifically, the lobes 125,127 is defined by the line portions 125',127'.

In FIG. 9, L1 denotes an available lift height, for the rocker arm 110 to control first fluid valve 180 while the two gas valves 4,5 are closed.

When switching from engine power mode (piston 162 in upper most position) to engine brake mode the first fluid circuit valve 152 is open and fluid can flow in forward direction activating the piston assembly 160 during an angle interval A1 when an fluid pressure in the fluid supply passage 154 exceeds p2. When an engine brake mode is continuously activated (the fluid pressure exceeds p2) some minor leakage of fluid may occur from the hydraulic circuit. This minor leakage of fluid can be compensated by each cam shaft revolution with fluid flow during angle interval A2. The result is zero lash adjustment for the second rocker arm 108 when gas valve 5 is in a closed position.

Operation in accordance with a first method embodiment, using the device 100 for actuating the engine gas valves 4,5, will now be explained during positive power (non-engine braking) operation of the engine. The fluid circuit 150 is then deactivated (lower pressure than p1). With reference to FIGS. 1-9, engine operation causes the cam shaft 102 to rotate. Since the cam 116 is rigidly attached to the cam shaft 102 and in contact with its associated roller 118 on the first rocker arm 110, the rotation of the cam shaft 102 causes the exhaust rocker arm 110 to pivot about the rocker shaft 104 and actuate the exhaust valves 4,5 for main exhaust lift events via the valve bridge 114 in response to interaction between the main exhaust lobe 117 on the cam 116 and the exhaust cam roller 118.

In the de-activated state, the fluid circuit 150 may be operated so as not to continually supply low pressure hydraulic fluid to the control fluid supply passage 154. As a result, hydraulic fluid pressure in the hydraulic passage 156 is insufficient to overcome the bias of the actuator piston control valve spring 164. The absence of any appreciable hydraulic fluid pressure in the actuator piston assembly 160 permits the spring 164 to push the actuator piston 162 into its upper most position, creating a lash space between the actuator piston and the sliding pin 124. The lash space is sufficiently great to exist between the actuator piston 160 and the sliding pin 124 both when the cam roller 122 is in contact with the base circle portion of the cam 116 and when the cam roller 122 is in contact with the cam lobes 125,127. Accordingly, throughout the rotation of the cam 120 during positive power operation of the engine, the actuator piston assembly 160 does not make contact with the sliding pin 124, and the exhaust valve 5 is not actuated for engine braking.

Turning now to engine braking operation, when exhaust valve actuation is desired for engine braking, the fluid pressure in the control fluid supply passage 154 may be increased (larger pressure than p2). Increased fluid pressure in the control fluid supply passage 154 is applied through the hydraulic passage 156 to the actuator piston 162. As a result, the actuator piston 162 may be displaced in the bore into an "engine brake on" position against the bias of the spring 164. The actuator piston 162 may then extend downward, out of its bore, thereby eliminating the lash space between the actuator piston 162 and the sliding pin 124. As long as the fluid pressure is larger than p2 the actuator piston 162 is maintained in the "engine brake on" position. The actuator piston 162 may be hydraulically locked by check valve 170 into this extended position.

Thereafter, pivoting of the engine braking rocker ante 112 caused by the lobe 125 of the cam 120 pushing the cam roller 122 upward may produce an engine braking valve actuation corresponding to the cam lobe profile, ie its shape and size. The engine braking event occurs because the cam lobe 125 of the cam 120 pivots the engine braking rocker arm 112, which causes the actuator piston (in its extended position) to push the sliding pin 124 downward, which in turn pushes the exhaust valve 5 open. When the cam 120 rotates so that the base circle portion is in contact with the cam roller 122, there will be no gap (zero lash) between the actuator piston 162 and the sliding pin 124, which permits the exhaust valve 5 to close.

When engine braking valve actuation is no longer desired, pressure in the control fluid supply passage 154 may be reduced or vented, and the actuator piston 162 will return to an "engine brake off" position. The system then returns to positive power operation.

It is to be understood that the present invention is not limited to the embodiments described above and illustrated in the drawings; rather, the skilled person will recognize that many changes and modifications may be made within the scope of the appended claims. For example, it is appreciated that the exhaust rocker arm 110 could be implemented as an intake rocker arm, and the engine braking rocker arm 112 could be used to provide auxiliary intake valve actuations, without departing from the intended scope of the invention. Furthermore, various embodiments of the invention may include a means for biasing the engine braking rocker arm 112 implemented using different spring orientations.

Further, the first fluid circuit valve may be situated in a position different from what has been disclosed above. For example, the first fluid circuit valve may be positioned between the check valve 170 and the actuator piston assembly 160. According to a further example, the first fluid circuit valve 152 may be positioned externally of the second rocker arm. For example, the first fluid circuit valve may be situated upstream of the second rocker arm in a fluid supply line in or to the rocker arm shaft (it may require a separate first fluid circuit valve for each cylinder.

Further, as a complementary device, a cam phaser might be used for changing phase angle between the engine crankshaft and the engine camshaft.

The invention claimed is:

1. A gas valve actuation device for an internal combustion engine, the gas valve actuation device comprising:

a first actuation means for actuating two gas valves in a first lift even;

a second actuation means for selectively actuating a first gas valve of the two gas valves in a second lift event;

a fluid circuit configured to control the actuating of the first gas valve during the second lift event, wherein the fluid circuit comprises a first fluid circuit valve controlled by the first actuation means such that the first fluid circuit valve is closed only during the first lift event, for creating conditions for achieving an exact positioning of the second actuation means in an engaged state of the second actuation means.

2. The gas valve actuation device according to claim 1, wherein the second actuation means comprises the fluid circuit.

3. The gas valve actuation device according to claim 1, wherein the first actuation means comprises a first rocker arm and the second actuation means comprises a second rocker arm.

4. The gas valve actuation device according to claim 3, wherein the first fluid circuit valve comprises a control member moveably arranged so as to open and close the first fluid circuit valve by a movement of the first rocker arm.

5. The gas valve actuation device according to claim 4, wherein the control member is adapted to engage with the first rocker arm.

6. The gas valve actuation device according to claim 5, wherein the control member is configured to move in a direction substantially in parallel with a movement direction of the two gas valves during the first lift event.

7. The gas valve actuation device according to claim 5, wherein the control member comprises a first end including a first contact surface, wherein the first contact surface is adapted to engage with a corresponding contact surface of the first rocker arm.

8. The gas valve actuation device according to claim 7, wherein the first fluid circuit valve comprises a spring-biased part adapted to control fluid flow in the fluid circuit, wherein the control member is arranged to actuate the spring-biased part, wherein the control member further comprises a second end including a second contact surface, wherein the second contact surface is arranged to engage with the spring-biased part.

9. The gas valve actuation device according to claim 5, wherein the control member is slidably arranged in a bore.

10. The gas valve actuation device according to claim 5, wherein the control member includes a cylindrical body.

11. The gas valve actuation device according to claim 4, wherein the control member is moveably arranged in the second rocker arm.

12. The gas valve actuation device according to claim 4, wherein the first fluid circuit valve comprises a spring-biased part adapted to control fluid flow in the fluid circuit, and wherein the control member is arranged to actuate the spring-biased part.

13. The gas valve actuation device according to claim 4, wherein the first rocker arm comprises a contact portion adapted to engage the control member.

14. The gas valve actuation device according to claim 13, wherein the first rocker arm has a main extension direction perpendicular to a rotational axis of the camshaft arrangement, wherein the first rocker arm comprises a boss projecting parallel to the rotational axis, and wherein the boss comprises the contact portion.

15. The gas valve actuation device according to claim 3, further comprising a rocker arm shaft, wherein the second rocker arm is pivotally arranged on the rocker arm shaft.

16. The gas valve actuation device according to claim 15, wherein the rocker arm shaft comprises a fluid supply passage adapted to provide fluid to the fluid circuit.

17. The gas valve actuation device according to claim 3, further comprising a camshaft arrangement provided with a first cam configured to actuate the first rocker arm during the first lift event and a second cam configured to actuate the second rocker arm during the second lift event.

18. The gas valve actuation device according to claim 3, further comprising a valve bridge extending between the two gas valves, wherein the first rocker arm is configured to actuate the two gas valves via the valve bridge.

19. The gas valve actuation device according to 3, further comprising a valve bridge extending between the two gas valves wherein the first rocker arm is configured to actuate the two gas valves via the valve bridge, wherein the valve bridge comprises an opening aligned with the first gas valve, and wherein the second rocker arm is configured to selectively actuate the first gas valve via a sliding pin arranged in the opening.

20. The gas valve actuation device according to claim 1, wherein the fluid circuit further comprises an actuator piston configured to control the first one of the two gas valves in gas valve during the second event.

21. The gas valve actuation device according to claim 20, wherein the first fluid circuit valve is arranged to control fluid supply to the actuator piston.

22. The gas valve actuation device according to claim 1, wherein the fluid circuit further comprises a check valve configured to prevent a reverse fluid flow in the fluid circuit, wherein the check valve is arranged in series with the first fluid circuit valve.

23. The gas valve actuation device according to claim 1, wherein the two gas valves are exhaust valves.

24. An internal combustion engine comprising:

a cylinder provided with a gas valve actuation device according to claim 1, wherein the two gas valves are two intake valves or the two exhaust valves.

* * * * *